US011491414B2

(12) United States Patent
Bagley

(10) Patent No.: US 11,491,414 B2
(45) Date of Patent: Nov. 8, 2022

(54) INTERLOCKING BUILDING BLOCK TOY

(71) Applicant: Gracewood Management, Inc., West Valley City, UT (US)

(72) Inventor: Jim Matthews Bagley, West Valley City, UT (US)

(73) Assignee: Gracewood Management, Inc., West Valley City, UT (US)

( * ) Notice: Subject to any disclaimer, the term of this patent is extended or adjusted under 35 U.S.C. 154(b) by 0 days.

(21) Appl. No.: 17/138,470

(22) Filed: Dec. 30, 2020

(65) Prior Publication Data

US 2022/0203254 A1 Jun. 30, 2022

(51) Int. Cl.
*A63H 33/08* (2006.01)
*A63H 33/06* (2006.01)

(52) U.S. Cl.
CPC ..... *A63H 33/082* (2013.01); *A63H 33/067* (2013.01); *A63H 33/08* (2013.01); *A63H 33/088* (2013.01)

(58) Field of Classification Search
CPC ..... A63H 33/06; A63H 33/08; A63H 33/088
See application file for complete search history.

(56) References Cited

U.S. PATENT DOCUMENTS

| | | | | |
|---|---|---|---|---|
| 3,882,630 | A * | 5/1975 | Bianco | A63H 33/088 446/85 |
| 3,905,150 | A * | 9/1975 | Dawn | A63H 33/088 446/124 |
| 5,378,185 | A | 1/1995 | Ban | |
| 5,853,313 | A | 12/1998 | Zheng | |
| 6,116,981 | A | 9/2000 | Zheng | |
| 9,724,618 | B2 | 8/2017 | Ben Shalom | |
| 10,039,991 | B2 | 8/2018 | Fernandez et al. | |
| 10,334,966 | B2 | 7/2019 | Adair | |
| 10,926,185 | B1 * | 2/2021 | Pihl | A63H 33/086 |
| 2019/0170173 | A1 * | 6/2019 | Aboud | A63H 33/086 |

* cited by examiner

*Primary Examiner* — John A Ricci
(74) *Attorney, Agent, or Firm* — Barnes & Thornburg LLP; Ryan L. Marshall; Jessica Kiser

(57) ABSTRACT

A construction toy set comprising a plurality of construction pieces is disclosed herein. Each construction piece of the plurality of construction pieces includes a planar body having a top surface and a bottom surface opposite the top surface and spaced apart relative to the top surface.

20 Claims, 6 Drawing Sheets

INTERLOCKING BUILDING BLOCK TOY

FIELD OF DISCLOSURE

The present disclosure relates generally to toys, and more specifically to building block toys.

BACKGROUND

This invention refers to construction or building block toys, and in particular to, interconnecting construction pieces.

Children have played with and learned from their play with building blocks for many years. Such building blocks include different types of blocks, from rudimentary stackable blocks to interlocking or otherwise engaging block systems. Such building blocks, however, have limited interconnection options that provide little variation to the different shapes being constructed. It is an object of the present invention to provide a set of construction blocks or pieces with a variety of interconnection options.

SUMMARY

The present disclosure may comprise one or more of the following features and combinations thereof.

A construction toy set may comprise a plurality of construction pieces. Each construction piece of the plurality of construction pieces may comprise a planar body, a pair of tabs, and a pair of notches.

In some embodiments, the planar body may include a top surface, a bottom surface, and four lateral edge surfaces. The bottom surface may be opposite the top surface. The bottom surface may be spaced apart relative to the top surface to define a thickness of the planar body. The lateral edge surfaces may extend between and interconnect the top surface and the bottom surface.

In some embodiments, the pair of tabs may extend away from opposite lateral edge surfaces of the planar body at a center of a corresponding lateral edge surface. The pair of notches may extend into the other two opposite lateral edge surfaces of the planar body perpendicular to the pair of tabs.

In some embodiments, each of the tabs may be shaped to include a first edge surface, a second edge surface, and a terminal end surface. The second edge surface may be spaced apart relative to the first edge surface to define a tab width of each of the tabs. The terminal end surface may extend between and interconnect the first and second edge surfaces. The terminal end surface may be spaced apart relative to the corresponding lateral edge surface to define a tab length of each of the tabs.

In some embodiments, each of the notches may be configured to receive one tab of an adjacent construction piece. Each of the notches may receive the corresponding tab to interlock adjacent construction pieces together.

In some embodiments, each construction piece of the plurality of construction pieces may have an overall length and an overall width. The overall length may be defined between the terminal end surface of one tab and the terminal end surface of the other tab. The overall width may be defined between the other two opposite lateral edges surfaces.

In some embodiments, each of the notches may have a notch length and a notch width. The notch length may be equal to the tab width of each of the tabs. The notch width may be equal to the tab length of each of the tabs.

In some embodiments, the lengths may be equal so that the terminal end surface of each of the tabs is flush with one of the top surface and the bottom surface of the adjacent construction piece when one tab of the pair of tabs is located in a corresponding notch of the adjacent construction piece. In some embodiments, the tab length of each of the tabs may equal to the tab width of each of the tabs.

In some embodiments, the planar body may be shaped to include a tab hole. The tab hole may extend through the planar body from the top surface to the bottom surface at a center of the planar body. In some embodiments, the tab hole may be octagram-shaped.

In some embodiments, the tab hole may have a central axis. The central axis may be perpendicular to the top and bottom surfaces of the planar body. The tab hole may be configured to receive one tab of the adjacent construction piece to interlock the adjacent construction pieces together so that the adjacent construction piece extends along and is parallel to the central axis.

In some embodiments, the tab hole may be shaped to include at least two tab channels. The tab channels may be angularly offset relative to each other at an offset angle relative to the central axis.

In some embodiments, each tab channel of the at least two tab channels may have a channel length and a channel width. The channel length may be equal to the tab length of each of the tabs. The channel width may be equal to the tab width of each of the tabs.

In some embodiments, the offset angle between the at least two tab channels is about 45 degrees. In some embodiments, the tab hole may be shaped to include more than two tab channels and the offset angle between two tab channels of the more than two tab channels may be less than 45 degrees.

In some embodiments, the top surface of the planar body may be shaped to include a top recess and the bottom surface of the planar body may be shaped to include a bottom recess. The top recess may extend into the top surface. The bottom recess may extend into the bottom surface.

In some embodiments, the planar body may be shaped to include a tab hole. The tab hole may extend through the planar body from the top surface to the bottom surface at the center of the planar body. In some embodiments, the tab hole may be octagram-shaped.

In some embodiments, the tab hole may have a central axis that is perpendicular to the top and bottom surfaces of the planar body. The tab hole may be configured to receive one tab of the adjacent construction piece to interlock the adjacent construction pieces together so that the adjacent construction piece extends along and is parallel to the central axis.

In some embodiments, the tab hole may be shaped to include at least two tab channels. The tab channels may be angularly offset relative to each other at an offset angle relative to the central axis.

In some embodiments, each tab channel of the at least two tab channels may have a channel length and a channel width. The channel length may be equal to the tab length of each of the tabs. The channel width may be equal to the tab width of each of the tabs.

According to another aspect of the present disclosure, a construction toy set may comprise a plurality of construction pieces. Each construction piece of the plurality of construction pieces may comprise a planar body, a pair of tabs, and a pair of notches.

In some embodiments, the planar body may include a top surface, a bottom surface, and four lateral edge surfaces. The bottom surface may be opposite the top surface and may be spaced apart relative to the top surface. The lateral edge surfaces may extend between and interconnect the top surface and the bottom surface.

In some embodiments, the pair of tabs may extend away from opposite lateral edge surfaces of the planar body at a center of a corresponding lateral edge surface. Each of the tabs may extend away from the lateral edge surface to a terminal end surface spaced apart from the planar body.

In some embodiments, the pair of notches may extend into the other two opposite lateral edge surfaces of the planar body perpendicular to the pair of tabs. Each of the notches may be configured to receive one tab of an adjacent construction piece to interlock adjacent construction pieces together.

In some embodiments, each construction piece of the plurality of construction pieces may have an overall length and an overall width. The overall length may be measured from the terminal end surface of one tab to the terminal end surface of the other tab. The overall width may be measured between the other two opposite lateral edges surfaces.

In some embodiments, each of the tabs may be shaped to include a first edge surface and a second edge surface. The second edge surface may be spaced apart relative to the first edge surface to define a tab width of each of the tabs.

In some embodiments, the terminal end surface may extend between and interconnect the first and second edge surfaces. The terminal end surface may be spaced apart relative to the planar body to define a tab length of each of the tabs. In some embodiments, the tab length of each of the tabs may be equal to the tab width of each of the tabs.

In some embodiments, each of the notches may have a notch length and a notch width. The notch length may be equal to the tab width of each of the tabs. The notch width may be equal to the tab length of each of the tabs so that the terminal end surface of each of the tabs is flush with one of the top surface and the bottom surface of the adjacent construction piece when one tab is located in a corresponding notch of the adjacent construction piece.

In some embodiments, the planar body may be shaped to include a tab hole. The tab hole may extend through the planar body from the top surface to the bottom surface at a center of the planar body. In some embodiments, the hole may be octagram-shaped.

In some embodiments, the hole may have a central axis that is perpendicular to the top and bottom surfaces of the planar body. The hole may be configured to receive one tab of the adjacent construction piece to interlock the adjacent construction pieces together so that the adjacent construction piece extends along and is parallel to the central axis.

In some embodiments, the tab hole may be shaped to include at least two tab channels. The two tab channels may be angularly offset relative to each other at an offset angle relative to the central axis. In some embodiments, the offset angle between the at least two tab channels may be about 45 degrees.

These and other features of the present disclosure will become more apparent from the following description of the illustrative embodiments.

BRIEF DESCRIPTION OF THE DRAWINGS

FIG. 3 is an exploded elevation view of adjacent construction pieces included in the plurality of construction pieces of FIG. 1 showing each of the tabs has a first side surface, a second side surface spaced apart from the first side surface to define a tab width, and a terminal end that extends between the first and second surfaces and spaced apart from the lateral edge to define a tab length of the tab;

DETAILED DESCRIPTION OF THE DRAWINGS

Figure 1:
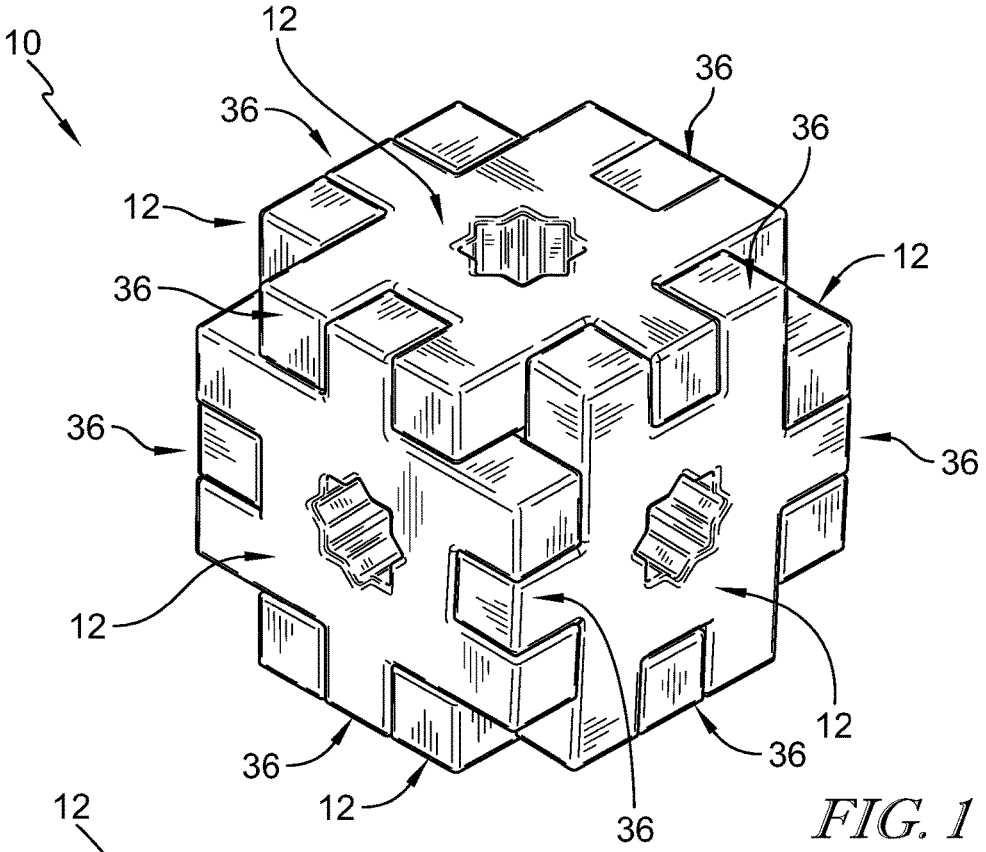
FIG. 1 is a perspective view of a construction toy set comprising a plurality of construction pieces that are each configured to interlock with each other to form intricate shapes and objects.

For the purposes of promoting an understanding of the principles of the disclosure, reference will now be made to a number of illustrative embodiments illustrated in the drawings and specific language will be used to describe the same.

An illustrative construction toy set 10 is shown in FIG. 1, which includes a plurality of construction pieces 12. The plurality of construction pieces 12 are rectangular shaped in the illustrative embodiments.

Each of the plurality of construction pieces 12 include a planar body 14, a pair of tabs 16, 18, and a pair of notches 20, 22 as shown in FIGS. 2-7. The planar body 14 has a top surface 24, a bottom surface 26, and four lateral edge surfaces 28, 30, 32, 34. The bottom surface 26 is opposite the top surface 24 and spaced apart in relation to the top surface 26 to define a thickness 25 of the planar body 14. The lateral edge surfaces 28, 30, 32, 34 extend between and interconnect the top surface 24 and the bottom surface 26.

The adjacent construction pieces 12' are identical to the construction pieces 12. Each adjacent construction piece 12' includes the planar body 14', the pair of tabs 16',18', and the pair of notches 20',22' as shown in FIGS. 3-10. The planar body 14' has the top surface 24', the bottom surface 26', and the four lateral edge surfaces 28',30',32',34' that extend between and interconnect the top surface 24' and the bottom surface 26'. The description of the construction pieces 12 is incorporated by reference to apply to the adjacent construction pieces 12'.

The tabs 16, 18 extend away from opposite lateral edge surfaces 28, 32 of the planar body 14 at a center of the corresponding lateral edge surface 28, 32, while the notches 20, 22 extend into opposite lateral edge surfaces 30, 34 of the planar body 14. Each notch 20, 22 is configured to receive one tab 16',18' of an adjacent construction piece 12' to interlock the adjacent construction pieces 12, 12' together.

Each of the tabs 16, 18 is shaped to include a first edge surface 40, a second edge surface 42, and a terminal end surface 44 as shown in FIGS. 2-7. The second edge surface 42 is spaced apart relative to the first edge surface 40 to define a tab width 46 of each tab 16, 18. The terminal end surface 44 extends between and interconnects the first and second edge surfaces 40, 42. The terminal end surface 44 is spaced apart relative to the planar body 14 to define a tab length 48 of each tab 16, 18. In the illustrative embodiment, each tab 16, 18 has the same thickness 25 as the planar body 14 such that the top and bottom surfaces 24, 26 are flush with the tabs 16, 18.

Figure 2:
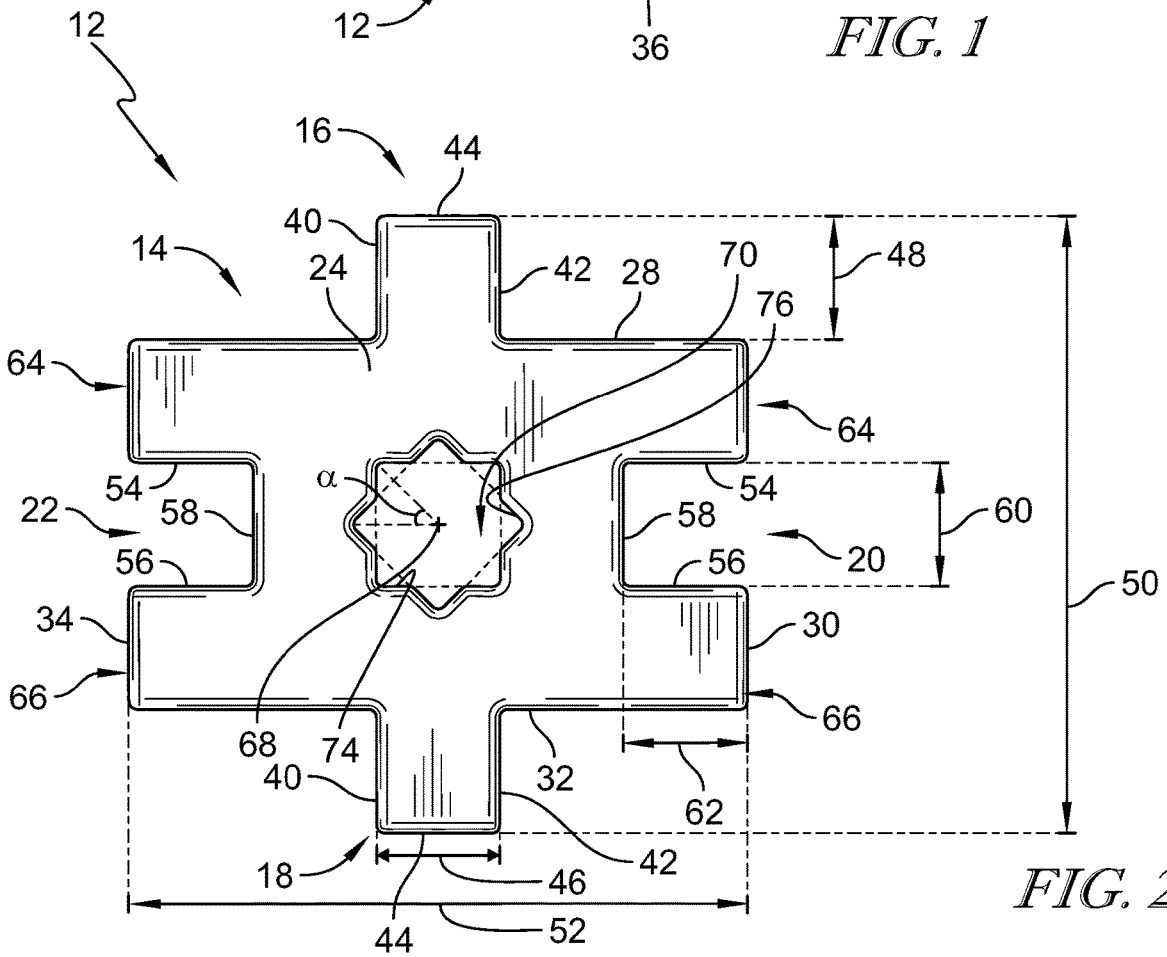
FIG. 2 is an elevation view of one construction piece of the plurality of construction pieces of FIG. 1 showing each construction piece includes a planar body, a pair of tabs that each extend away from opposite lateral edge surfaces of the planar body, and a pair of notches that each extend into the other opposite lateral edge surfaces and are configured to receive one tab of an adjacent construction piece to interlock the pieces together.
Figure 3:
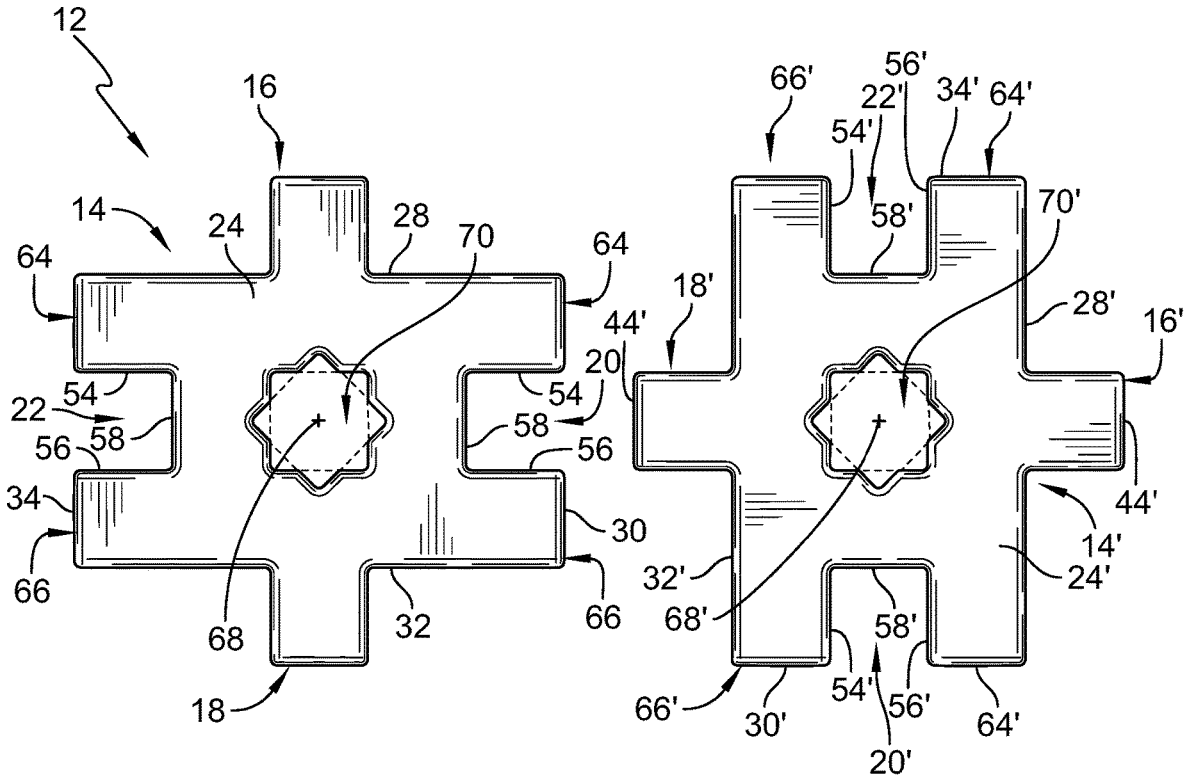
FIG. 3 is an exploded elevation view of adjacent construction pieces included in the plurality of construction pieces of FIG. 1 showing each of the tabs has a first side surface and a second side surface spaced apart from the first side surface to define a tab width of the tab that is equal to a notch length of each notch.

Each construction piece 12 of the plurality of construction pieces 12 has an overall length 50 and an overall width 52 that is equal to the overall length 50 as shown in FIG. 2. The overall length 50 is defined between the terminal end surface 44 of one tab 16 and the terminal end surface 44 of the other tab 18. The overall width 52 is defined between the other two opposite lateral edges surfaces 30, 34. The overall width 52 is equal to the overall length 50 such that the piece 12 has the square shape.

Each of the notches 20, 22 is defined by a first edge surface 54, a second edge surface 56, and an end surface 58 as shown in FIGS. 2-6. The second edge surface 56 is spaced apart from the first edge surface 54 to define a notch length 60 of each notch 20, 22. The end surface 58 is spaced apart from the lateral edge surface 30, 34 to define a notch width 62 of each notch 20, 22.

The notch length 60 of each notch 20, 22 is equal to the tab width 46 of each tab 20, 22, while the notch width 62 of each notch 20, 22 is equal to the tab length 48 of each tab 16, 18 as shown in FIG. 2. In this way, the terminal end surface 44 of each of the tabs 16, 18 is flush with one of the top surface 24' and the bottom surface 26' of the adjacent construction piece 12' when one tab 16, 18 is located in the corresponding notch 20',22' of the adjacent construction piece 12'.

Figure 6:
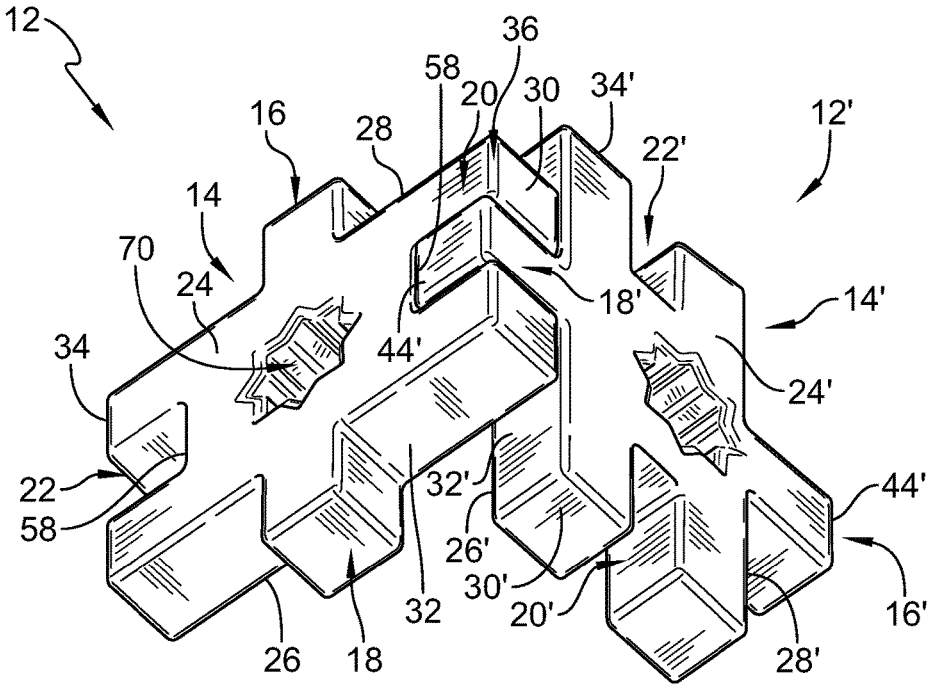
FIG. 6 is a view similar to FIG. 5 showing the tab width and the tab length of each tab is equal to a notch width and a notch length of the tab such that the terminal end of the tab is flush with a top or a bottom surface of the planar body.
Figure 7:
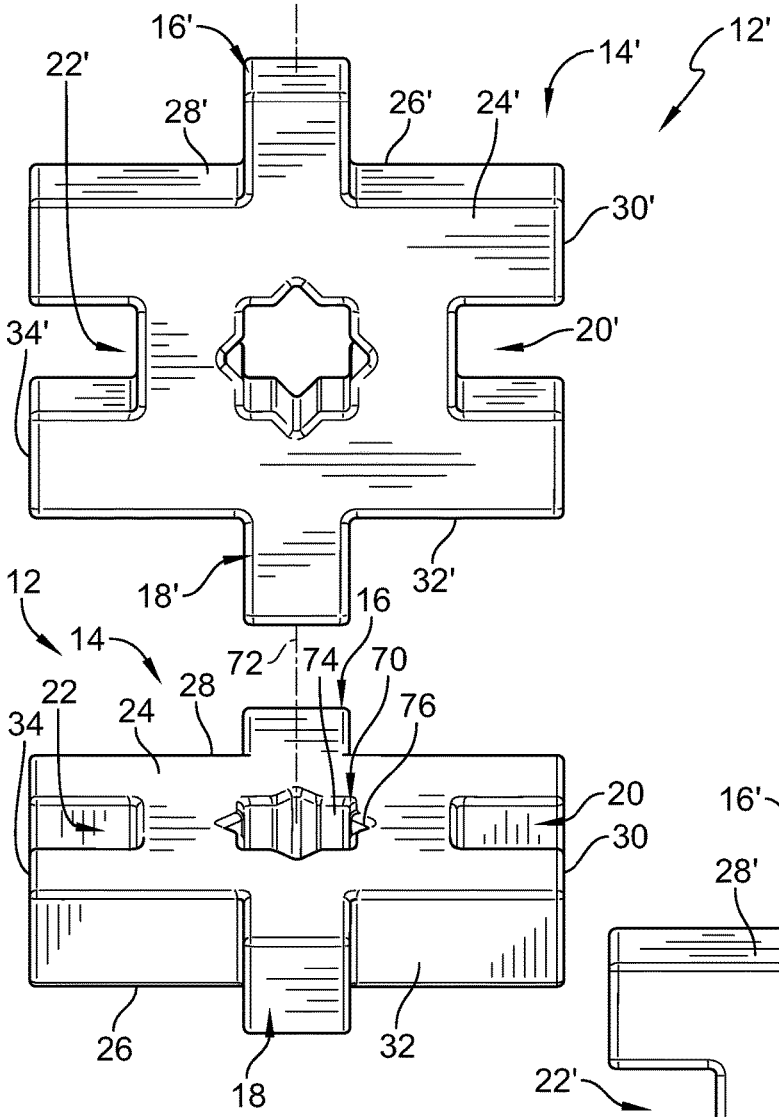
FIG. 7 is an exploded view of adjacent construction pieces included in the plurality of construction pieces of FIG. 1 showing the planar body of each construction piece includes a tab hole that extends along a tab hole axis through the planar body and is configured to receive one tab of the adjacent construction piece.

For instance, the terminal end surface 44' of the tab 18' of the adjacent construction piece 12' is flush with top surface 24 of the construction piece 12 and the surface 30 is flush with the top surface 24' of the adjacent piece 12' as shown in FIG. 6. This creates a single edge 36 between the adjacent pieces 12, 12' such that no tab 16, 18, 16',18' sticks out past the adjacent surface 44',30. For instance, the plurality of construction pieces 12 form a cube as shown in FIG. 1 that has a plurality of flush edges 36.

In the illustrative embodiment, the lateral edge surface 28, one of the lateral edge surfaces 30, 34, and the first edge surface 54 of the notch 20, 22 form a tab 64 as shown in FIG. 2. Similarly, the lateral edge surface 32, one of the lateral edge surfaces 30, 34, and the second edge surface 56 of the notch 20, 22 form a tab 66. The tabs 64, 66 are configured to be received in a notch 20',22' of the adjacent construction piece 12'.

Turning again to the planar body 14 of each construction piece 12, the planar body 14 is shaped to include a tab hole 70 as shown in FIGS. 2-8. The tab hole 70 extends through the planar body 14 from the top surface 24 to the bottom surface 26 at a center 68 of the planar body 14.

Figure 8:
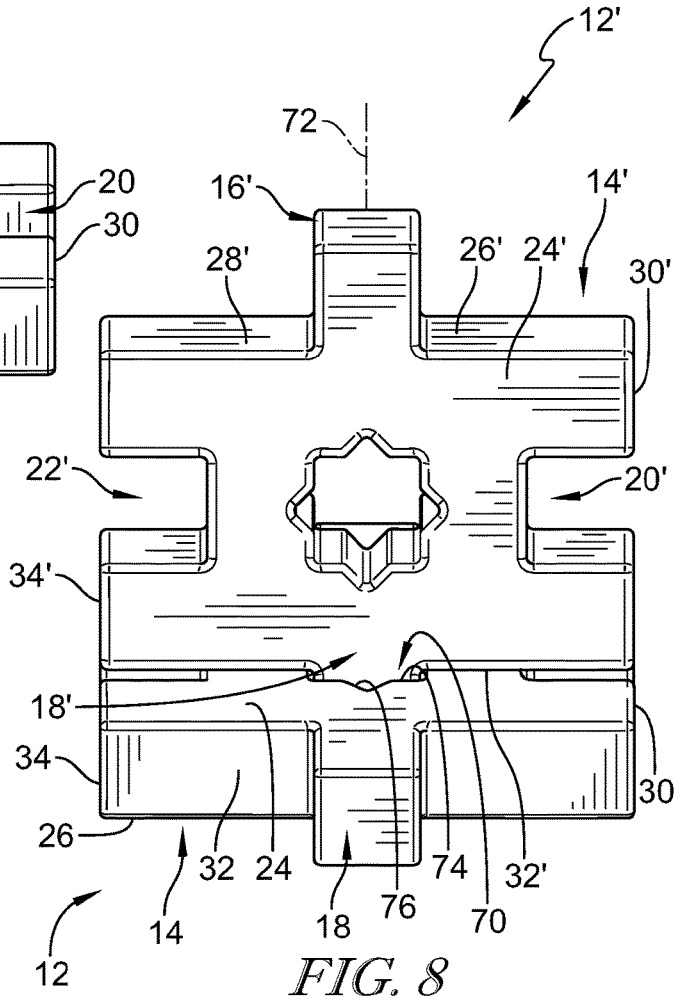
FIG. 8 is a view similar to FIG. 7 showing the tab of the adjacent construction piece arranged in the tab hole so that the adjacent construction piece extends along and is parallel to the tab hole axis.
Figure 9:
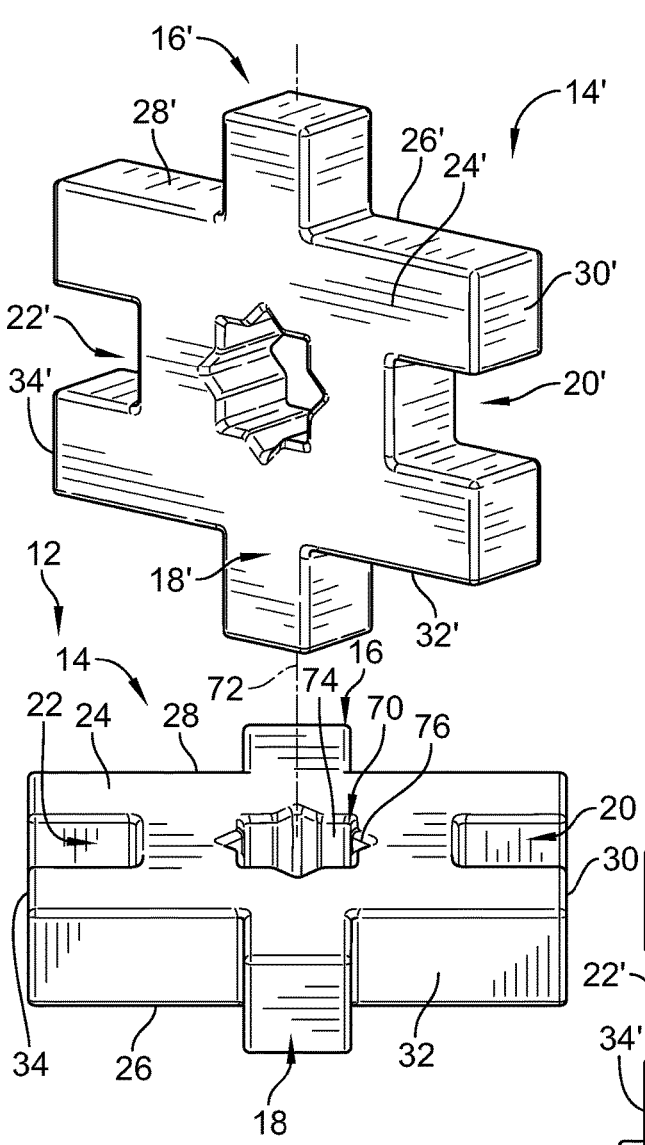
FIG. 9 is an exploded view of adjacent construction pieces included in the plurality of construction pieces of FIG. 1 showing the tab hole is shaped to include tab channels angularly offset relative to each other so that the adjacent construction piece may be angled relative to the other construction piece.
Figure 10:
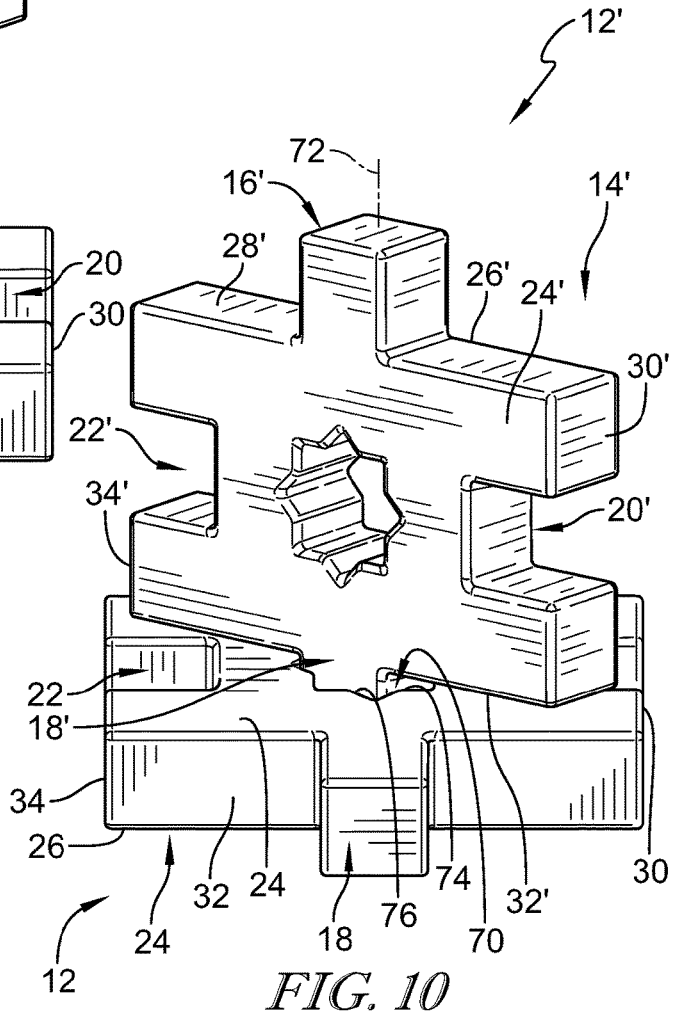
FIG. 10 is a view similar to FIG. 9 showing the tab of the adjacent construction piece arranged in the tab hole so that top and bottom surfaces extend at an offset angle relative to the lateral edge surfaces of the other construction piece.

The tab hole 70 has a central axis 68 that is perpendicular to the top and bottom surfaces 24, 26 of the planar body 14 as shown in FIGS. 2-6. The tab hole 70 is configured to receive one tab 16',18' of the adjacent construction piece 12' to interlock the adjacent construction pieces 12' together. For instance, the tab 18' of the adjacent construction piece 12' is inserted into the tab hole 70 of the construction piece 12 as shown in FIGS. 8-10. The tab hole 70 receives the tab 16',18' so that the adjacent construction piece 12' extends along and is parallel to the central axis 72 of the tab hole 70. In the illustrative embodiment, the tab hole 70 is octagram-shaped.

The tab hole 70 is shaped to include at least two, concentric tab channels 74, 76 as shown in FIGS. 2-7. The tab channels 74, 76 are angularly offset relative to each other at an offset angle $\alpha$ relative to the central axis 72. Each tab channel 74, 76 has a channel length equal to the tab length 48 of the tabs 16, 18 and a channel width equal to the tab width 46 of the tabs 16, 18.

The tab channel 74 is aligned with the tabs 16, 18 and the notches 20, 22 such that when the tab 16',18' of an adjacent construction piece 12' is inserted into the tab channel 74, the top and bottom surfaces 24',26' of the adjacent construction piece 12' are parallel to at least one of the lateral edge surfaces 28, 30, 32, 34. The other tab channel 76 is angularly offset from the tab channel 74 such that when the tab 16,' 18' of an adjacent construction piece 12' is inserted into the tab channel 76', the top and bottom surfaces 24',26' extend at the offset angle $\alpha$ relative to the lateral edge surfaces 28, 30, 32, 34. The offset angle between the tab channels 74, 76 is about 45 degrees in the illustrative embodiment.

In other embodiments, the tab hole 70 is shaped to include more than two tab channels 74, 76. The plurality of tab channels 74, 76 are angularly offset relative to each other. The offset angle between two tab channels 74, 76 of included in the plurality of tab channels 74, 76 may be less than 45 degrees.

Figure 4:
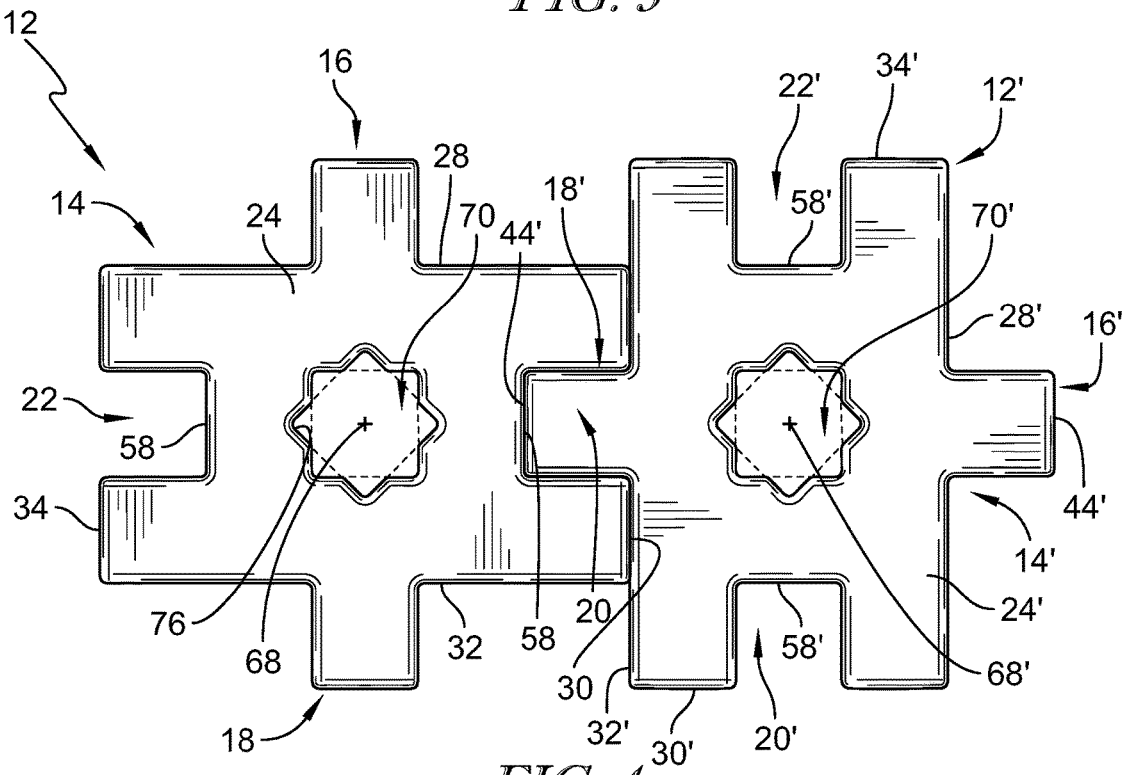
FIG. 4 is a view similar to FIG. 3 showing the tab of one construction piece inserted into the notch of the other construction piece.
Figure 5:
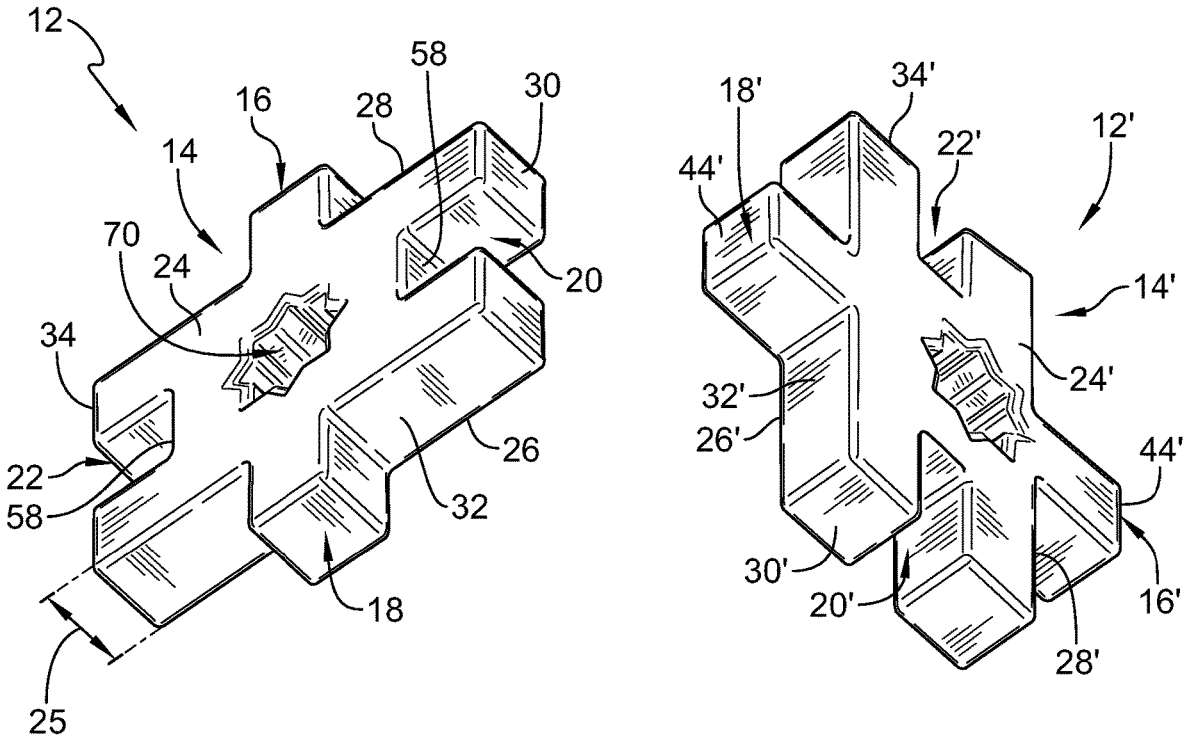
FIG. 5 is an exploded view of adjacent construction pieces included in the plurality of construction pieces of FIG. 1 showing the tab of one construction piece may be inserted into the notch of the adjacent construction piece at an angle.

The construction pieces 12, 12' may be assembled together in a plurality of different arrangements as shown in FIGS. 3-10. One method of assembling two construction pieces 12, 12' together may include inserting one of the tabs 16' 18' of the adjacent construction piece 12' into one of the notches 20, 22 such that the terminal end surface 44' of the adjacent construction piece 12' contacts the end surface 58 of the construction piece 12 as shown in FIG. 4.

Additionally, the pieces 12, 12' may be arranged perpendicular to one another to form the edge 36 between two pieces 12, 12'. To assembly the pieces 12, 12' in this arrangement, one of the tabs 16',18' of the adjacent construction piece 12' may be inserted into one notch 20, 22 so that the terminal end surface 44' of the adjacent piece 12' is flush with the top surface 24 or bottom surface 26 of the other piece 12. In this arrangement, the lateral surface 30, 34 is also flush with the top surface 24' or bottom surface 26' of the adjacent piece 12'.

Another method of assembling two construction pieces 12, 12' together may include inserting one of the tabs 64, 66 formed by the notches 20, 22 on the lateral edge surfaces 30, 34 into the notch 20',22' of the adjacent construction piece 12'. The tabs 64, 66 may be inserted into the notch 20',22' of the adjacent piece 12' so that the lateral surface 30, 34 contacts the end surface 58' in the notch 20',22'.

The pieces 12, 12' may also be arranged perpendicular to one another by inserting one of the tabs 64, 66 formed by the notches 20, 22 on the lateral edge surfaces 30, 34 into the notch 20',22' of the adjacent construction piece 12' to form the edge 36. The tabs 64, 66 are inserted so that the lateral edge surfaces 30, 34 are flush with the lateral edge surfaces 30',34' of the adjacent piece 12'.

Another method of assembling two construction pieces 12, 12' together may include interconnecting one notch 20, 22 with one notch 20',22' of the adjacent construction piece 12'. The top and bottom surfaces 24, 26 of one piece 12 may be arranged perpendicular to the top and bottom surfaces 24',26' of the adjacent piece 12' with the notch 20, 22 aligned with the other notch 20',22'. The notch 20, 22 may then be interconnected with the other notch 20',22' of the piece 12' by contacting the end surfaces 58, 58'. The first and second edge surfaces 54, 56 of one notch 20, 22 would then extend over the top and bottom surfaces 24',26' of the adjacent piece 12', while the first and second edge surfaces 54',56' of the notch 20',22' of the adjacent piece 12' extends over the top and bottom surfaces 24, 26.

Another method of assembling two construction pieces 12, 12' together may include inserting one tab 16',18' of the adjacent construction piece 12' into the tab hole 70 of the construction piece 12. The tab 16' 18' may be inserted into the tab hole 70 in several different ways. One way to insert the tab 16',18' into the tab hole 70 would be to align the tab 16',18' of the adjacent piece 12' with the tab channel 74 and inserting the tab 16',18' in the tab channel 74.

The tab 16',18' of the adjacent piece 12' may be inserted in the tab channel 74 so that the top and bottom surfaces 24',26' adjacent piece 12' are parallel to the lateral edges 28, 32 of the other piece 12. Additionally, the tab 16',18' of the adjacent piece 12' may be inserted in the tab channel 74 so that the top and bottom surfaces 24',26' adjacent piece 12' are parallel to the lateral edge surfaces 30, 34 of the other piece 12.

Another way to insert the tab 16',18' into the tab hole 70 would be to align the tab 16',18' of the adjacent piece 12' with the tab channel 76 and inserting the tab 16',18' in the tab channel 76 as shown in FIG. 10. The tab 16',18' of the adjacent piece 12' may be inserted in the tab channel 76 in four different orientations each offset at 45 degrees. Another method of assembling two construction pieces 12, 12' together may include inserting one of the tabs 64',66' of the adjacent construction piece 12' into the tab hole 70 of the construction piece 12.

Figure 11:
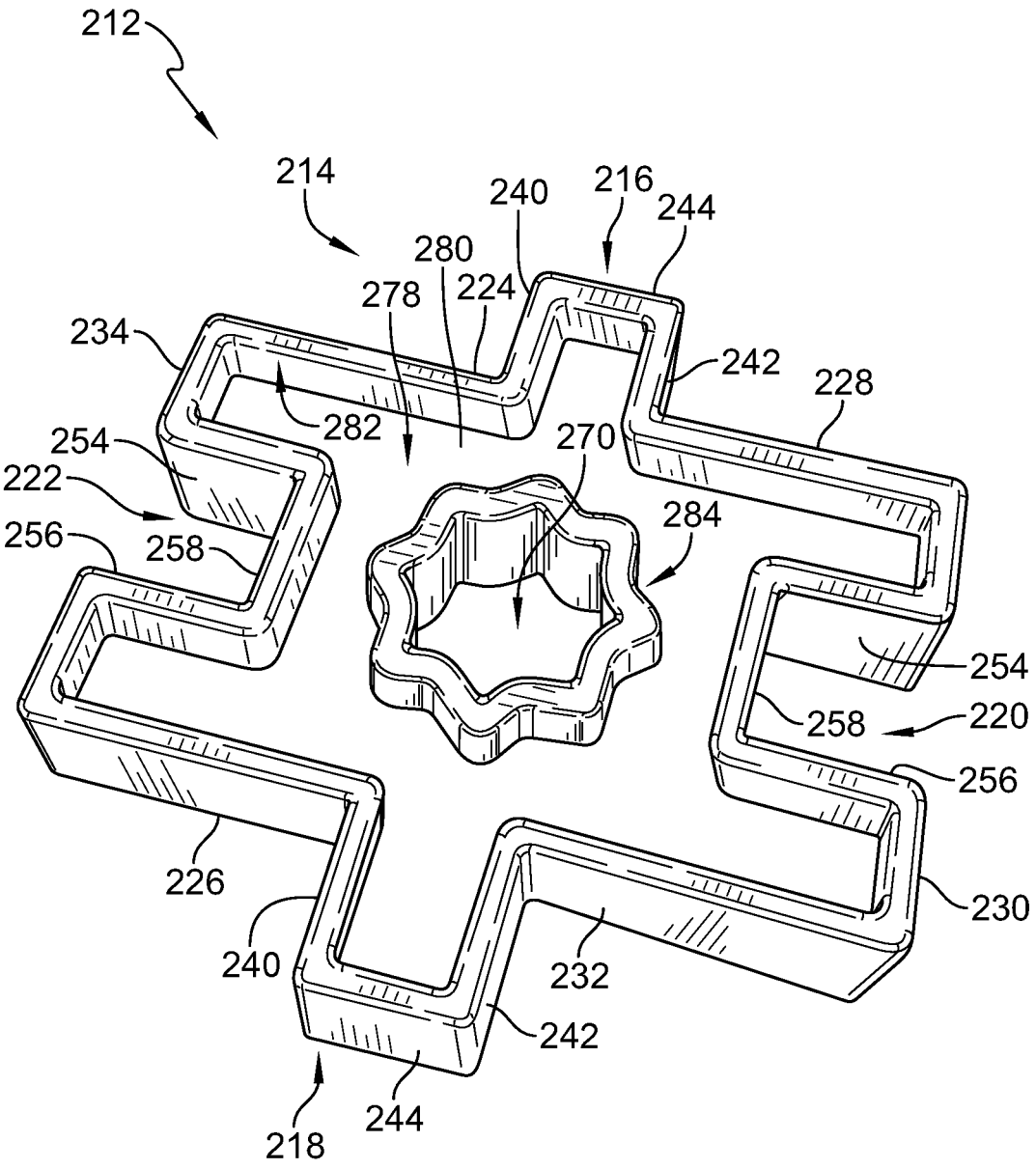
FIG. 11 is another embodiment of a construction piece showing the construction piece includes a planar body, a pair of tabs, and a pair of notches

Another embodiment of a construction piece 212 in accordance with the present disclosure is shown in FIG. 11. The construction piece 212 is substantially similar to the construction piece 12 shown in FIGS. 1-10 and described herein. Accordingly, similar reference numbers in the 200 series indicate features that are common between the construction piece 12 and the construction piece 212. The description of the construction piece 12 is incorporated by reference to apply to the construction piece 212, except in instances when it conflicts with the specific description and the drawings of the construction piece 212.

Each of the plurality of construction pieces 212 include a planar body 214, a pair of tabs 216, 218, and a pair of notches 220, 222 as shown in FIG. 11. The planar body 214 has a top surface 224, a bottom surface 226, and four lateral edge surfaces 228, 230, 232, 234. The bottom surface 226 is opposite the top surface 224 and spaced apart in relation to the top surface 226. The lateral edge surfaces 228, 230, 232, 234 extend between and interconnect the top surface 224 and the bottom surface 226.

In the illustrative embodiment, the top surface 224 of the planar body 214 is shaped to include a top recess 278 as shown in FIG. 11. The top recess 278 extends into the top surface 224 to a surface 280 to define ridges 282 along a perimeter of the construction piece 212 and ridges 284 along a perimeter of the tab hole 270 extending through the top and bottom surfaces 224, 226.

The perimeter of the construction piece 212 is formed by the four lateral edge surfaces 228, 230, 232, 234, the edge surfaces 240, 242, 244 of the tabs 216, 218, and the edge surfaces 254, 256, 258 of the notches 220, 222 as shown in FIG. 11. The perimeter of the tab hole 270 follows the octagram shape of the tab hole 270.

In the illustrative embodiment, the bottom surface 226 of the planar body 214 is shaped to include a bottom recess (not shown), which mirrors the top recess 278. The bottom recess extends into the bottom surface 226 to define the ridges 282, 284. The recesses 278 may reduce the overall weight of the construction piece 212.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A construction toy set comprising a plurality of construction pieces, each construction piece of the plurality of construction pieces comprising:

a planar body including a top surface, a bottom surface opposite the top surface and spaced apart relative to the top surface to define a thickness of the planar body, and four lateral edge surfaces that extend between and interconnect the top surface and the bottom surface, a pair of tabs that extend away from opposite lateral edge surfaces of the planar body at a center of a corresponding lateral edge surface, each of the tabs shaped to include a first edge surface, a second edge surface spaced apart relative to the first edge surface to define a tab width of each of the tabs, and a terminal end surface that extends between and interconnects the first and second edge surfaces, wherein the terminal end surface is spaced apart relative to the corresponding lateral edge surface to define a tab length of each of the tabs, and a pair of notches that extend into the other two opposite lateral edge surfaces of the planar body perpendicular to the pair of tabs and each of the notches configured to receive one tab of an adjacent construction piece to interlock adjacent construction pieces together, wherein each construction piece of the plurality of construction pieces has an overall length defined between the terminal end surface of one tab and the terminal end surface of the other tab and an overall width defined between the other two opposite lateral edges surfaces, and wherein the planar body is shaped to include a tab hole that extends through the planar body from the top surface to the bottom surface at a center of the planar body, the tab hole having a central axis that is perpendicular to the top and bottom surfaces of the planar body, and the tab hole is configured to receive one tab of the adjacent construction piece to interlock the adjacent construction pieces together so that the adjacent construction piece extends along and is parallel to the central axis.

2. The construction toy set of claim 1, wherein each of the notches has a notch length equal to the tab width of each of the tabs and a notch width equal to the tab length of each of the tabs so that the terminal end surface of each of the tabs is flush with one of the top surface and the bottom surface of the adjacent construction piece when one tab of the pair of tabs is located in a corresponding notch of the adjacent construction piece.

3. The construction toy set of claim 2, wherein the tab length of each of the tabs is equal to the tab width of each of the tabs.

4. The construction toy set of claim 3, wherein the tab hole is octagram-shaped.

5. The construction toy set of claim 3, wherein the tab hole is shaped to include at least two tab channels angularly offset relative to each other at an offset angle relative to the central axis, each tab channel of the at least two tab channels having a channel length equal to the tab length of each of the tabs and a channel width equal to the tab width of each of the tabs.

6. The construction toy set of claim 5, wherein the offset angle between the at least two tab channels is about 45 degrees.

7. The construction toy set of claim 5, wherein the tab hole is shaped to include more than two tab channels and the offset angle between two tab channels of the more than two tab channels is less than 45 degrees.

8. The construction toy set of claim 3, wherein the top surface of the planar body is shaped to include a top recess that extends into the top surface and the bottom surface of the planar body is shaped to include a bottom recess that extends into the bottom surface.

9. The construction toy set of claim 1, wherein the tab hole is octagram-shaped.

10. The construction toy set of claim 1, wherein the tab hole is shaped to include at least two tab channels angularly offset relative to each other at an offset angle relative to the central axis, each tab channel of the at least two tab channels having a channel length equal to the tab length of each of the tabs and a channel width equal to the tab width of each of the tabs.

11. The construction toy set of claim 1, wherein the tab hole has a width equal to the tab width of each of the tabs and a length equal to the tab length of each of the tabs and wherein the tab length of each of the tabs is equal to the tab width of each of the tabs.

12. A construction toy set comprising a plurality of construction pieces, each construction piece of the plurality of construction pieces comprising:

a planar body including a top surface, a bottom surface opposite the top surface and spaced apart relative to the top surface, and four lateral edge surfaces that extend between and interconnect the top surface and the bottom surface, a pair of tabs that extend away from opposite lateral edge surfaces of the planar body at a center of a corresponding lateral edge surface to a terminal end surface spaced apart from the planar body, and a pair of notches that extend into the other two opposite lateral edge surfaces of the planar body perpendicular to the pair of tabs and each of the notches configured to receive one tab of an adjacent construction piece to interlock adjacent construction pieces together, wherein each construction piece of the plurality of construction pieces has an overall length measured from the terminal end surface of one tab to the terminal end surface of the other tab and an overall width measured between the other two opposite lateral edges surfaces, and wherein the overall width of each construction piece of the plurality of construction pieces is equal the overall length.

13. The construction toy set of claim 12, wherein each of the tabs shaped to include a first edge surface and a second edge surface spaced apart relative to the first edge surface to define a tab width of each of the tabs, the terminal end surface extends between and interconnects the first and second edge surfaces, and the terminal end surface is spaced apart relative to the planar body to define a tab length of each of the tabs.

14. The construction toy set of claim 13, wherein the tab length of each of the tabs is equal to the tab width of each of the tabs.

15. The construction toy set of claim 13, wherein each of the notches has a notch length equal to the tab width of each of the tabs and a notch width equal to the tab length of each of the tabs so that the terminal end surface of each of the tabs is flush with one of the top surface and the bottom surface of the adjacent construction piece when one tab of the pair of tabs is located in a corresponding notch of the adjacent construction piece.

16. The construction toy set of claim 12, wherein the planar body is shaped to include a tab hole that extends through the planar body from the top surface to the bottom surface at a center of the planar body, the hole having a central axis that is perpendicular to the top and bottom surfaces of the planar body, and the hole is configured to receive one tab of the adjacent construction piece to interlock the adjacent construction pieces together so that the adjacent construction piece extends along and is parallel to the central axis.

17. The construction toy set of claim 16, wherein the hole is octagram-shaped.

18. The construction toy set of claim 16, wherein the tab hole is shaped to include at least two tab channels angularly offset relative to each other at an offset angle relative to the central axis.

19. The construction toy set of claim 18, wherein the offset angle between the at least two tab channels is about 45 degrees.

20. The construction toy set of claim 16, wherein the tab hole has a width equal to the tab width of each of the tabs and a length equal to the tab length of each of the tabs and wherein the tab length of each of the tabs is equal to the tab width of each of the tabs.

* * * * *